United States Patent [19]

Bishop

[11] Patent Number: 4,850,150

[45] Date of Patent: Jul. 25, 1989

[54] HAND HELD DRILL WITH INTEGRAL DRILL BIT SHARPENER

[76] Inventor: Steven C. Bishop, 210 Washington, Mecosta, Mich. 49332

[21] Appl. No.: 272,244

[22] Filed: Nov. 16, 1988

[51] Int. Cl.[4] ..... B24B 3/26

[52] U.S. Cl. ..... 51/128; 51/5 E; 51/241 G; 51/219 R

[58] Field of Search ..... 51/128, 219 R, 219 PC, 51/181 R, 241 R, 241 G, 5 R, 5 B, 5 E

[56] References Cited

U.S. PATENT DOCUMENTS

| | | | |
|---|---|---|---|
| 1,231,258 | 6/1917 | Horvath | 51/124 |
| 2,372,794 | 4/1945 | Ricks | 51/120 |
| 2,424,470 | 7/1947 | Kronwall | 51/219 R |
| 2,540,320 | 2/1951 | Cayo | 120/91 |
| 2,601,748 | 7/1952 | Lohr | 51/108 |
| 2,800,755 | 7/1957 | Perra | 51/219 R |
| 2,848,852 | 8/1958 | Rosholt | 51/219 R |
| 3,224,146 | 12/1965 | Ahlström | 51/90 |
| 3,341,981 | 9/1967 | Baronyak | 51/241 R |
| 3,393,477 | 7/1968 | Ahlström | 51/219 R |
| 3,553,898 | 1/1971 | Noble | 51/73 |
| 3,694,967 | 10/1972 | Stielper | 51/219 R |
| 3,698,140 | 10/1972 | Steadman | 51/241 G |
| 3,742,652 | 7/1973 | Enders | 51/73 R |
| 3,753,320 | 8/1973 | Wurscher | 51/219 R |
| 3,783,955 | 1/1974 | Gill | 51/128 |
| 3,803,771 | 4/1974 | Bunn | 51/128 |

FOREIGN PATENT DOCUMENTS

| | | | |
|---|---|---|---|
| 0939152 | 1/1974 | Canada | 51/128 |
| 1477470 | 9/1969 | Fed. Rep. of Germany | 51/5 E |
| 1552062 | 11/1968 | France . | |
| 126809 | 11/1949 | Sweden . | |
| 1202600 | 8/1970 | United Kingdom . | |

*Primary Examiner*—Frederick R. Schmidt
*Assistant Examiner*—Robert Rose
*Attorney, Agent, or Firm*—Basile and Hanlon

[57] ABSTRACT

A drill bit sharpener in combination with a hand held electric power drill having a chuck, an electric motor and a drive shaft powering the chuck. The sharpener includes an abrasive wheel supported within the hand held housing of the electric power drill for rotation about a central axis. The abrasive wheel has a cupped concave angled grinding face disposed facing the hand held housing. The housing has a single passageway parallel to and off set from the central axis. An aperture is disposed within the housing normal to and communicating with the single passageway. A first stationary pin is engaged within the aperture extending outwardly into the single passageway for engaging a first flute on a drill bit inserted through the single passageway. A second reciprocal pin extends outwardly into the single passageway, opposing the first pin, for engaging a second flute of the drill bit to secure the drill bit against rotation. A rotatable plate is disposed on an external surface of the housing and has a plurality of apertures individually alignable over the single passageway for selectively locating a desired size aperture in communication with the single passageway allowing insertion of a correspondingly sized drill bit for sharpening. Each aperture on the rotatable plate is disposed at a radial distance from the rotational axis of the shaft which in combination with the first and second pins defines an angular orientation of the drill bit with respect to the angled grinding face of the abrasive wheel.

2 Claims, 2 Drawing Sheets

HAND HELD DRILL WITH INTEGRAL DRILL BIT SHARPENER

FIELD OF THE INVENTION

The invention relates to a hand held power drill having a built-in drill bit sharpener.

BACKGROUND OF THE INVENTION

Many elaborate and complicated machines and assemblies have been desigend for sharpening a drill bit. The cost and size of the machines may be prohibitive for the individual to purchase and use. Moreover, these costly assemblies are generally quite heavy and are not readily portable. Also, the machines generally do not include a grinding wheel but require the previous existence of a motorized grinder of pedestal or bench type. This includes a separate source of rotary power to drive the grinding unit. Recent advancements in the art have been directed toward providing a drill bit grinding attachment for an electric hand drill, which is economically affordable and readily portable. However, these drill bit grinding attachments have been found to be unsatisfactory in that the attachment is easily misplaced and therefore unavailable when needed. In addition, the attachments are subject to damage during storage and transportation and therefore, again, may not be operable when needed.

The present invention seeks to resolve these and other disadvantages of the known drill bit sharpening mechanisms.

SUMMARY OF THE INVENTION

The invention includes a drill bit sharpener in combination with a hand held electric power drill having a chuck, an electric motor and a drive shaft powering the chuck. The sharpener includes an abrasive wheel supported within the hand held housing of the electric power drill for rotation about a central axis. The abrasive wheel is rotatatively driven by the electric motor simultaneously with the chuck. The abrasive wheel is disposed within the hand held housing with the electric motor disposed between the wheel and the chuck. The abrasive wheel has a cupped concave angled grinding face disposed facing the hand held housing. The housing has a single passageway parallel to and offset from the central axis. The single passageway is aligned with the angled grinding face of the abrasive wheel. An aperture is disposed within the housing normal to and communicating with the single passageway. A first stationary pin is engaged within the aperture having a generally conical surface extending outwardly into the single passageway for engaging a first flute on a drill bit inserted through the single passageway. A second reciprocal pin has a second generally conical surface extending outwardly into the single passageway opposing the first conical surface for engaging a second flute of the drill bit to secure the drill bit against rotation. The second pin is engaged within another portion of the aperture such that the first and second pins are coaxially aligned with one another. Spring means is provided for biasing the second pin outwardly into the single passageway. Rotatable plate means is disposed on an external surface of the housing and has a plurality of apertures individually alignable over the single passageway for selectively locating a desired sized aperture in communication with the single passageway allowing insertion of a correspondingly sized drill bit for sharpening.

Each aperture on the rotatable plate means is disposed at a radial distance from the rotational axis of the shaft which in combination with the first and second pins defines an angular orientation of the drill bit with respect to the angled grinding face of the abrasive wheel. Detent means are formed on the plate means for releasably locking the plate means in a separate selected stationary position for each aperture in the plate means, such that each aperture is individually locatable in communication with the single passageway.

The present invention advantageously incorporates the dril bit sharpening device within the hand held housing of the electric power drill, thereby assuring that the drill bit sharpening device is available for use whenever drilling operations are being performed. In addition, the present invention advantageously places the drill bit sharpening device rearward of the handle grip portion of the hand held power drill thereby providing a more balanced hand held unit by offsetting the weight distributed toward the forward portion of the drill with respect to the hand grip contributable to the electric motor and chuck driving components of the hand held power drill. Furthermore, the present invention advantageously provides the proper orientation of the drill bit landing with respect to the angled grinding face of the abrasive wheel by fixedly orientating the selected drill bit within an appropriately sized aperture through the rotatable plate means in combination with the first and second pins disposed within the housing.

Other features and advantages will become more apparent to those skilled in the art by reading the following detailed description of the invention in conjunction with the appended drawings.

BRIEF DESCRIPTION OF THE DRAWINGS

The description herein makes reference to the accompanying drawings wherein like reference numerals refer to like parts throughout the several views, and wherein.

DESCRIPTION OF THE PREFERRED EMBODIMENTS

Figure 1:
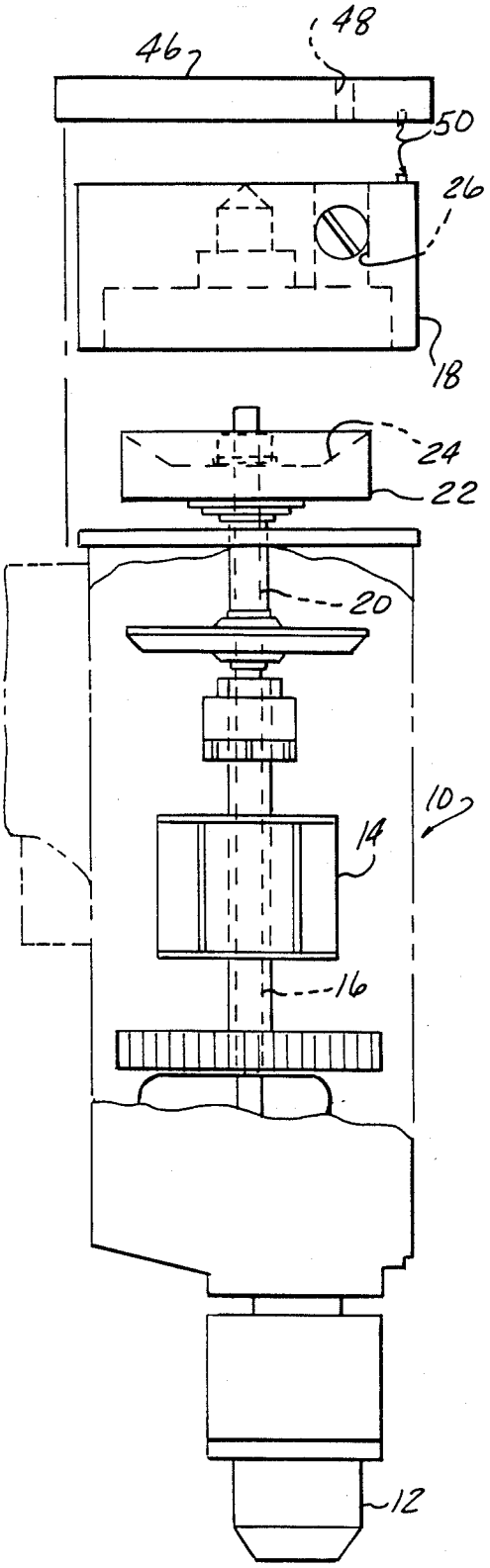
FIG. 1 is a partial exploded view of a drill sharpening device in combination with a hand held power drill.
Figure 2:
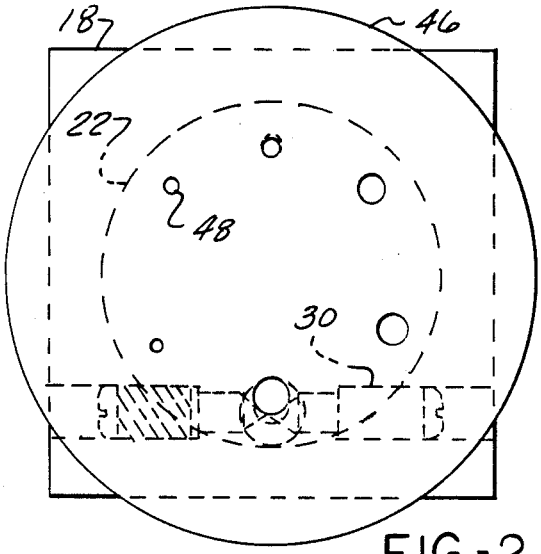
FIG. 2 is a top view of the drill sharpening device.
Figure 3:
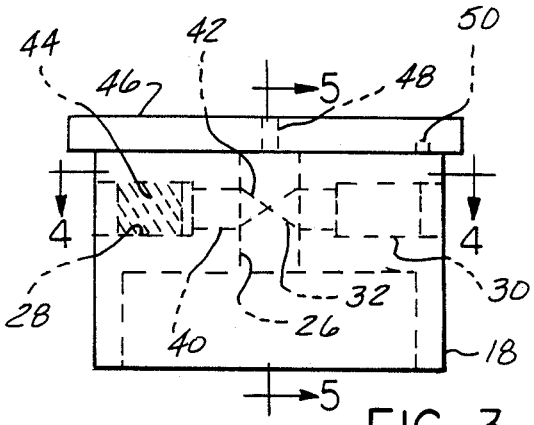
FIG. 3 is a side view of the drill sharpening device.

The drill bit sharpener according to the present invention is incorporated into a single unit in combination with a generally conventional hand held electric power drill 10 having a chuck 12, an electric motor 14, and a drive shaft 16 powering the chuck 12.

A housing 18 encloses a shaft 20 extending from the electric motor 14 for rotatably driving a rotary grinding element or abrasive wheel 22 having a cupped concave angled grinding face 24 disposed toward the housing 18. The abrasive wheel 22 is supported within the hand held housing 18 of the electric power drill 10 for rotation about a central axis. The abrasive wheel 22 is rotatively driven by the electric motor 14, as it simultaneously drives the chuck 12. The abrasive wheel 22 is disposed within the hand held housing 18 with the electric motor 14 disposed between the wheel 22 and the chuck 12. The housing 18 has a single passageway 26 parallel to and off set from the central axis. The single passageway 26 is aligned with the angled grinding face 24 of the abrasive wheel 22. An aperture 28 is disposed within the housing 18 normal to and communicating with the single passageway 26. A first stationary pin 30 is engaged within the aperture 28 having a generally conical surface 32 extending outwardly into the single passageway 26 for engaging a first flute or chip channel 36 on a drill bit 34 inserted through the single passageway 26. A second recriprocal pin 40 has a second generally conical surface 42 extending outwardly into the single passageway 26 opposing the first conical surface 32 of the first stationary pin 30. The second generally conical surface 42 of the second reciprocal pin 40 engages a second flute or chip channel 38 of the drill bit 34 to secure the drill bit 34 against rotation when inserted within the single passageway 26 for sharpening. The second pin 40 is engaged within a portion of the aperture 29 such that the first and second pins, 30 and 40 respectively, are co-axially aligned with one another. Spring means 44 bias the second pin 40 outwardly into the single passageway 26. Disposed on an external surface of the housing 18 is a rotatable plate means 46 having a plurality of apertures 48 individually alignable over the single passageway 26 of selectively locating a desired sized aperture in communication with the single passageway 26 allowing insertion of a correspondingly sized drill bit 40 for sharpening. Each aperture 48 on the rotatable plate means 46 is disposed at a radial distance from the rotational central axis of the shaft 20, which in combination with the first and second pins, 30 and 40 respectively, defines an angular orientation of the drill bit 40 with respect to the angled grinding face 24 of the abrasive wheel 22. Detent means 50 are formed between the plate means 46 in the housing 18 for releasably locking the plate 46 in a separate selected stationary position for each aperture 48 in the plate means 46, such that each aperture 48 is individually locatable in communication with the single passageway 26.

Figure 4:
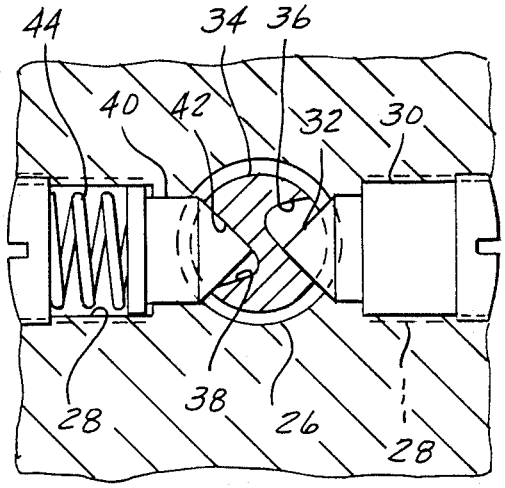
FIG. 4 is a cross-sectional detailed veiw of the first and second pins within the drill sharpening device for engaging flutes of the drill bit to secure the drill bit against rotation.
Figure 5:
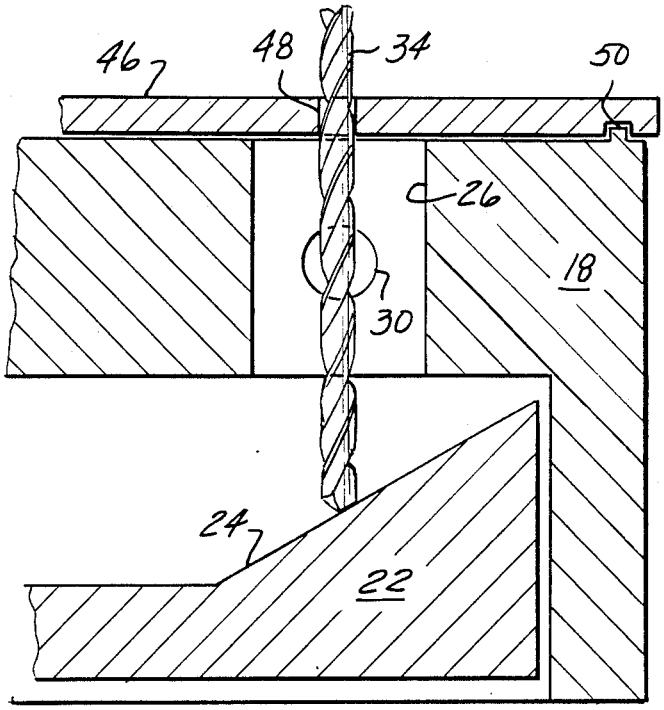
FIG. 5 is a partial cross-sectional detailed view taken as shown in FIG. 3.
Figure 6:
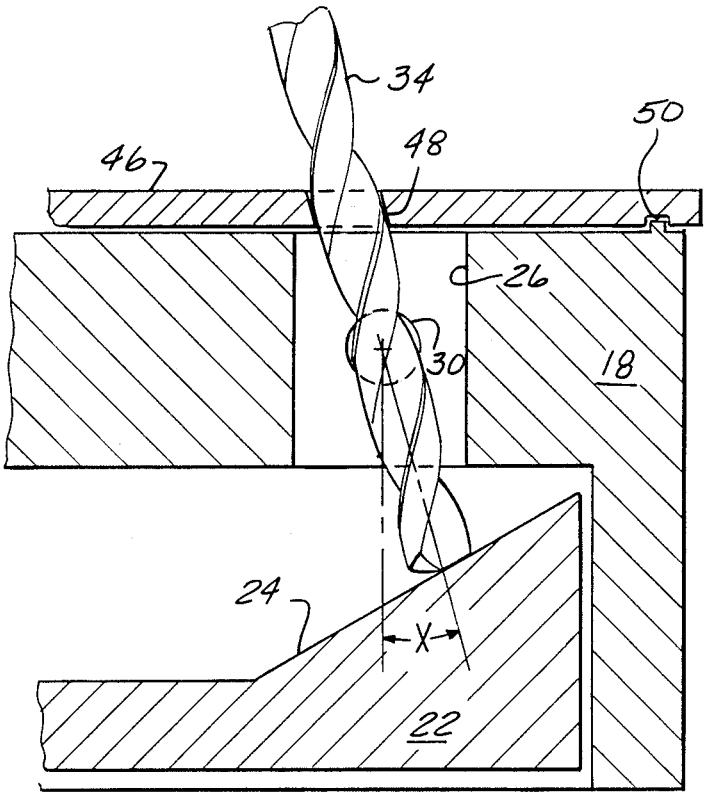
FIG. 6 is a partial cross-sectional detailed view similar to FIG. 5 showing the angular orientation of a different drill bit after insertion for sharpening.

In use, the hand held electric power drill 10 is gripped in the conventional manner by grasping the hand grip portion. The rotatable plate means 46 is rotated until the desired aperture 48 is disposed in communication with the single passageway 26. In this selected orientation, the detent means 50 releasably locks the plate means 46 in the selected stationary position for this particular aperture 48. As best seen in FIGS. 5 and 6, a correspondingly sized drill bit 34 is inserted through the aperture 48 in the plate means 46. As best seen in FIG. 4, the first and second flutes or chip channels, 36 and 38 respectively, of the drill bit 34 are engaged by the first and second pins, 30 and 40 respectively. As the drill bit 34 is inserted further toward the angled grinding face 24 of the abrasive wheel 22, the drill bit 34 rotates as the first and second pins, 30 and 40, engage within the first and second flutes 36 and 38. When the drill bit 34 engages the angled grinding face 24, the drill bit 34 is disposed in the proper orientation to sharpen the landing of the drill bit 34. The drill bit 34 is fixedly disposed in this orientation by the combination of the appropriately sized aperture 48 in the plate means 46 and the first and second pins, 30 and 40 respectively, engaging the first and second flutes 36 and 38 of the drill bit 34. In order to obtain the proper orientation, each aperture 48 on the rotatable plate means 46 is disposed at a radial distance from the rotational axis of the abrasive wheel 22, which in combination with the first and second pins defines an angular orientation X of the drill bit with respect to the angled grinding face 24 of the abrasive wheel 22. As can best be seen in FIG. 6, certain drill bits require a smaller radial distance to properly orientate the drill bit with respect to the angled grinding surface. In particular, it has been found that a $\frac{1}{4}$ inch diameter drill bit and a $\frac{1}{8}$ inch diameter drill bit require an angular orientation off set 15°, such that the drill bit is inclined toward the rotatable axis of the abrasive wheel for a proper orientation of the landing of the drill bit with respect to the angled grinding face of the abrasive wheel. It should be noted that in this configuration the angled grinding face of the abrasive wheel is disposed at approximately a 59° angle. Preferably, the aperture 28 is disposed $\frac{3}{4}$ of an inch above the surface of the abrasive wheel which is disposed normal to the shaft 20. Drill bit diameters of 3/32 inches, 5/32 inches, 3/16 inches, and 7/32 inches can be disposed at an orientation parallel to and off set from the central axis of the shaft 20. It has been found that these angular orientations for drill bit diameters in the range of 3/32 of an inch to $\frac{1}{4}$ inches produce a 118° drill point. Each drill bit, depending on its particular diameter, will move to a different position on the angled grinding face of the abrasive wheel. The rotatable plate includes straight or angular apertures 28 to position the drill bits respectively depending upon the angular orientation required for that particular size drill bit.

While the invention has been described in detail, it will be apparent to those skilled in the art that the disclosed invention may be modified. Therefore, the foregoing description is to be considered exemplary, rather than limiting, and the scope of the invention is that defined in the following claims.

The invention claimed is:

1. A drill bit sharpener in combination with a hand held electric power drill having a chuck, an electric motor and a drive shaft powering said chuck, the sharpner comprising:

an abrasive wheel supported within a hand held housing enclosing said hand held electric power drill, said abrasive wheel rotatable about a central axis and rotatably driven by said electric motor simultaneously with said chuck, said abrasive wheel disposed within said hand held housing with said electric motor disposed between said abrasive wheel and said chuck, said wheel having a cupped concave angled grinding face disposed facing said housing;

said housing having a single passageway parallel to and off set from said central axis and aligned with said grinding face and an aperture normal to and communicating with said single passageway;

a first stationary pin engaged within the aperture having a generally conical surface extending outwardly into said single passageway for engaging a first flute on a drill bit inserted through said single passageway;

a second reciprocal pin having a second generally conical surface extending outwardly into said single passageway opposing said first conical surface for engaging a second flute of said drill bit to secure said drill bit against rotation, said second pin engaged within a portion of said aperture such that said first and second pins co-axially align with one another;

spring means for biasing the second pin outwardly into said single passageway;

rotatable plate means having a plurality of apertures individually alignable over said single passageway for selectively locating a desired size aperture in communication with said single passageway allowing insertion of a correspondingly sized drill bit for sharpening, each aperture disppsed at a radial distance from the rotational axis of said shaft to define an angular orientation of said drill bit in combination with said first and second pins with respect to said grinding face of said abrasive wheel; and means formed on said plate means for releasably locking said plate means in a separate selected stationary position for each aperture in said plate means, such that each aperture is individually locatable in communication with said single passageway.

2. A drill bit sharpener in combination with an electric drill having a chuck, an electric motor and a drive shaft powering said chuck, said electric power drill disposed within a hand held housing, said sharpener comprising:

a shaft connected to said drive shaft extending outwardly from said electric motor opposite from said chuck;

a rotary grinding element connected to the shaft for rotation with the shaft powered by said electric motor, the grinding element having a concave angled surface facing outwardly with respect to said electric motor;

a cover attached to said housing enclosing the grinding element and having a single passageway parallel to and offset from the longitudinal axis of the shaft, the cover further having an aperture normal to and communicating with the single passageway;

a first stationary pin engaged within the aperture having a generally conical surface extending outwardly into the single passageway for engaging a first flute on a drill bit inserted through said single passageway;

a second reciprocal pin having a second generally conical surface extending outwardly into said single passageway opposing said first conical surface for engaging a second flute of said drill bit to secure said drill bit against rotation, said second pin engaged within a portion of said aperture such that said first and second pins co-axially align with one another;

spring means for biasing the second pin outwardly into the single passageway;

rotatable plate means having a plurality of apertures individually alignable over the single passageway of selectively locating a desired size aperture in communication with said single passageway allowing insertion of a corresponding sized drill bit for sharpening, each aperture disposed at a predetermined radial distance from the rotational axis of said shaft to define an angular orientation of said drill bit in combination with said first and second pins with respect to said angle surface of said rotary grinding element; and detent means formed on said cover and said plate means for releasably locking said plate means in a separate selected stationary position for each aperture in said plate means.

* * * * *